US008528806B2

(12) United States Patent
Sorrentino et al.

(10) Patent No.: US 8,528,806 B2
(45) **Date of Patent: *Sep. 10, 2013**

(54) DISPLAY CARTON FOR A PLURALITY OF PRODUCTS

(75) Inventors: Alan Sorrentino, Cranbury, NJ (US); Andreas Haefliger, Triengen (CH)

(73) Assignee: Colgate-Palmolive Company, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/294,414

(22) Filed: Nov. 11, 2011

(65) Prior Publication Data

US 2012/0080511 A1 Apr. 5, 2012

Related U.S. Application Data

(63) Continuation of application No. 13/326,272, filed on Dec. 2, 2008, now Pat. No. 8,066,178, which is a continuation of application No. PCT/US2008/085133, filed on Dec. 1, 2008.

(51) Int. Cl.
*B65D 5/46* (2006.01)
*B65D 5/48* (2006.01)

(52) U.S. Cl.
USPC ..... 229/117.18; 229/120.02

(58) Field of Classification Search
USPC ..... 229/223, 162.1, 162.7, 120.19, 120.33, 229/120.34, 120.38, 120.02; 206/769, 775, 206/776, 781; 220/810, 662, 665
See application file for complete search history.

(56) References Cited

U.S. PATENT DOCUMENTS

| | | | | |
|---|---|---|---|---|
| 2,597,845 | A | | 5/1952 | Reeser |
| 3,206,098 | A | | 9/1965 | Stenger et al. |
| 3,635,393 | A | * | 1/1972 | Herglotz ..... 229/125.15 |
| 3,870,221 | A | | 3/1975 | Zeitter |
| 3,937,328 | A | | 2/1976 | Gordon |
| 4,279,376 | A | | 7/1981 | Roccaforte |

(Continued)

FOREIGN PATENT DOCUMENTS

| | | |
|---|---|---|
| CN | 201587665 | 9/2010 |
| DE | 29508218 | 8/1995 |

(Continued)

OTHER PUBLICATIONS

International Search Report and Written Opinion in International Application No. PCT/US08/085133, mailed Dec. 14, 2009.

*Primary Examiner* — Nathan J Newhouse
*Assistant Examiner* — Christopher Demeree
(74) *Attorney, Agent, or Firm* — Judy W. Chung

(57) ABSTRACT

A carton comprising a front panel and a rear panel, the front panel and the rear panel connected one to the other by a top panel and a bottom panel, each of the front panel, the top panel and the bottom panel having appended side flaps, a product separator is located in the carton, the product separator secured in the carton by recesses on the appended side flaps. The product separator separates the carton into a first cavity and a second cavity, at least one product being disposed within each of the first cavity and the second cavity. The front panel is at least partially transparent. Each of the front panel flaps having an appended glue flap, the appended glue flaps having a plurality of glue tabs. The top panel and the rear panel having an appended hanger panel with an aperture and a structure to reclose the carton.

16 Claims, 9 Drawing Sheets

(56) References Cited

U.S. PATENT DOCUMENTS

| | | | |
|---|---|---|---|
| 4,355,758 | A | 10/1982 | Lavery |
| 4,512,511 | A | 4/1985 | Zimmermann |
| 6,523,694 | B2 | 2/2003 | Lux, Jr. et al. |
| 2002/0036152 | A1 | 3/2002 | Saiki et al. |
| 2005/0115843 | A1 | 6/2005 | Harrelson |
| 2005/0145683 | A1 | 7/2005 | Alagna et al. |
| 2007/0228130 | A1 | 10/2007 | Arai |

FOREIGN PATENT DOCUMENTS

| | | |
|---|---|---|
| EP | 0393298 | 10/1990 |
| GB | 725809 | 3/1955 |
| SU | 1754582 | 8/1991 |

* cited by examiner

DISPLAY CARTON FOR A PLURALITY OF PRODUCTS

CROSS REFERENCE TO RELATED APPLICATION

This application is a continuation of U.S. patent application Ser. No. 12/326,272 filed on Dec. 2, 2008, now U.S. Pat. No. 8,066,178 which is a continuation of International Application No. PCT/US2008/085133, filed on Dec. 1, 2008. The disclosures of the above applications are incorporated herein by reference.

BACKGROUND OF THE INVENTION

This invention relates to a display carton blank, and display carton for a plurality of products where the contained products are maintained in a set array in the carton. The carton is comprised of a carton and a separator, the separator being maintained in place by recesses in the sidewalls of the carton. The carton front surface can be at least partially transparent. Other surfaces also can be at least partially transparent.

Many products are sold in amounts of two to ten or more. Many of these products are preferably displayed and maintained in a set array in the carton. Being maintained in a set array is useful in cases where the units are to be seen through an at least partially transparent front surface. The units that can be seen through the front surface can be a significant factor in the product being purchased. The products are preferably displayed neatly to convey the proper message about the product to the prospective purchaser. In addition, the carton should be of a low cost, structurally stable, tamper evident and versatile in display. As used herein, versatile in display means that the carton can be displayed both resting on a store shelf and suspended from a peg or similar hardware that extends outwardly from a vertical support. When the product can be displayed sitting on a store shelf it then also can be stored on a shelf at the purchaser's residence. Storability by the purchaser is convenient because the units in the carton may be used over a period of time. The carton should have sufficient structural stability so as not to be damaged during shipping and handling and display at the retail outlet. It also should be sufficiently durable to protect the contained units from any damage. To be tamper evident, it should be discernable from a casual inspection whether the carton has been the subject of any tampering.

The present carton solves the above problems through a unique structure for the carton. The carton has a unique carton structure, a unique product separator structure, and a unique carton/product separator interfitting structure. Low cost is achieved by the use of a design that minimizes the amount of material yet maintains sufficient strength. This results in a display carton for a plurality of products at a low cost, one which is structurally stable, is tamper evident, and is versatile in display.

BRIEF SUMMARY OF THE INVENTION

The present invention is directed to a display carton for a plurality of products. In one embodiment, the carton comprises a front panel and a rear panel, the front panel and the rear panel connected one to the other by a top panel and a bottom panel, each of the front panel, the top panel and the bottom panel having appended side flaps. Each of the top panel and side panel appended side flaps has a recess, the recesses of the top panel flaps being in alignment with the recesses of the bottom panel flaps to form combined recesses in the sidewall of the carton. There is a product separator within the carton, the product separator having a separator panel with an appended first panel and an appended second panel, each of the first panel and the second panel being fitted into the combined recess in the sidewall of the carton to thereby secure the product separator within the carton. The product separator maintaining the position of the products displayed in the carton.

The carton has at least one surface which is at least partially transparent in order to display the container products. This preferably is the front surface. Other surfaces, such as the top surface can be at least partially transparent. The product separator will maintain the product units adjacent the front panel and any other panel with an at least partially transparent surface in a neat array.

The front panel side flaps have appended glue flaps, there being a score line between each of the side flaps and the glue flaps. The glue flap is at an angle to the side flap. Each glue flap has a plurality glue tabs, the appended glue flaps attaching to the rear panel of the carton.

The first panel and the second panel of the product separator have a shape which conforms to the shape of the combined recesses, the first panel and the second panel preferably having a rectangular shape with the combined recesses having a conforming rectangular shape.

The top panel has an attached first hanger panel and the rear panel has an attached second hanger panel, the first hanger panel and the second hanger panel jointly forming a common hanger panel of the carton. The second hanger panel has breakaway glue tabs to secure the rear panel in a closed position and a remaining bendable tab to maintain the rear panel closed.

The product separator has apertures and a product separator weakened area to promote a partial fold. The apertures provide for a gripping of the product separator. The partial fold provides for a way to insert and to remove the product separator. The product separator provides for product to be maintained between the front panel and the product separator and the rear panel and the product separator.

The carton is constructed from a carton blank which is comprised of a front panel with an attached top panel at one end and an attached bottom panel at another end. A rear panel is attached to the bottom panel. Each of the front panel, top panel and the bottom panel have side flaps, the rear panel being devoid of side flaps. The top panel has a first hanger panel and the rear panel has a second hanger panel, each hanger panel having an aperture. The top panel side flaps and the bottom panel side flaps each has a recess, the recesses aligning when the carton blank is formed into a carton to form common recesses. Each front panel flap has an appended glue flap, each glue flap having a plurality of glue tabs. The front panel of the carton blank is at least partially transparent.

The carton can be made of a wide range of materials. These range from various paperboards to various plastics.

DETAILED DESCRIPTION OF THE INVENTION

Figure 1:
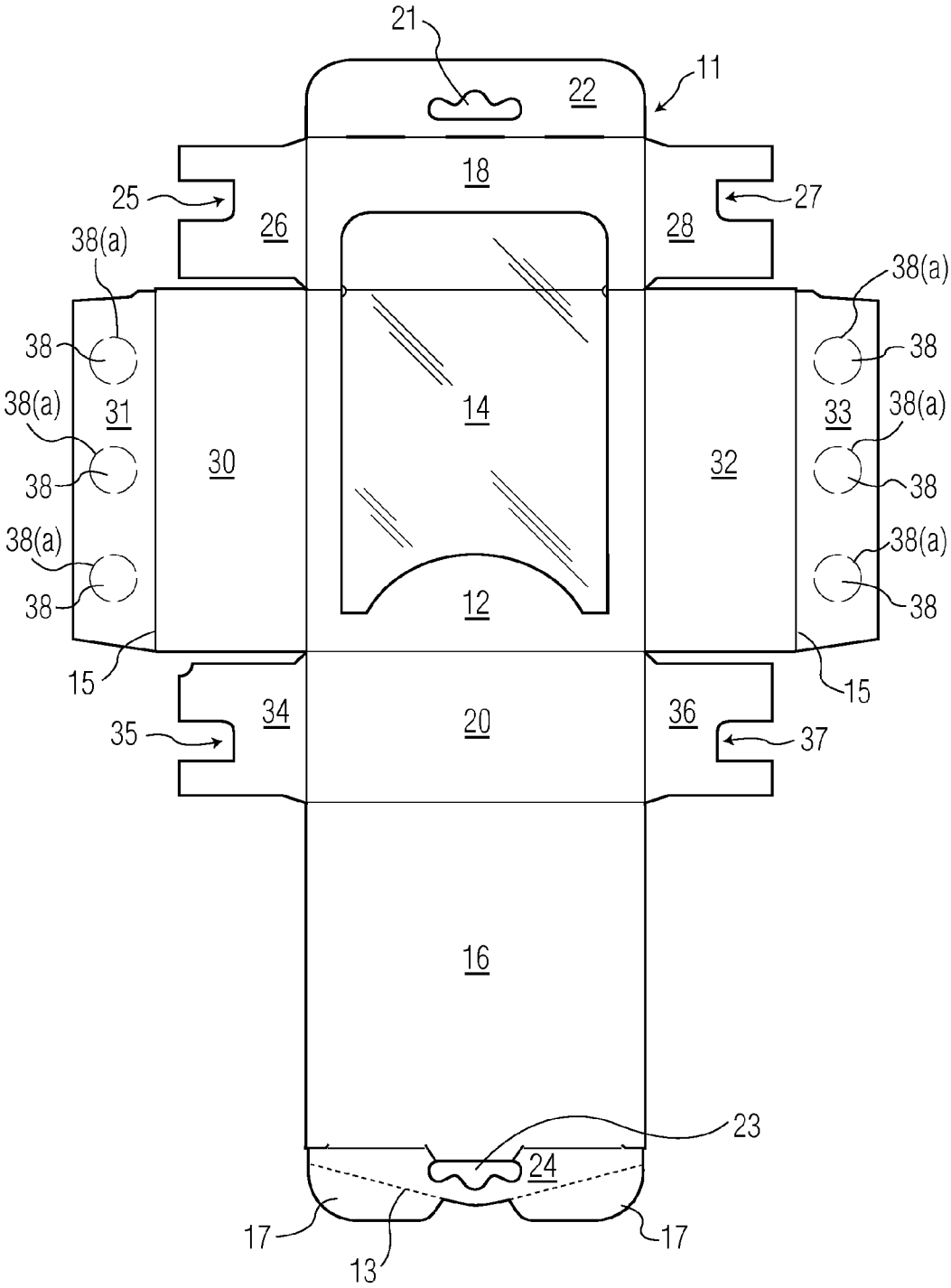
FIG. 1 is a plan view of the carton blank for forming the carton.

Referring to FIG. 1, a blank 11 for forming a display carton 10 (FIG. 4) is illustrated. The blank 11 is comprised of a front panel 12 with a transparent front panel window 14. At one end of the front panel 12 is a top panel 18. The transparent front panel window 14 of the front panel 12 is shown as extending into the top panel 18. The size, shape and orientation of the panel window 14 is not limited to that illustrated in FIG. 1. The panel window 14 could be smaller or larger and of any shape and orientation as long as products in the carton 10 are visible from outside of the carton 10. Attached to the top panel 18 is a first hanger panel 22 which has a first hanger panel aperture 21. Attached to the front panel 12 opposite the top panel 18 is a bottom panel 20 with a rear panel 16 attached to the other end of the bottom panel 20. Attached to the bottom panel 20 is a second hanger panel 24 which has a second hanger panel aperture 23. The second hanger panel 24 has a plurality of weakened lines 13 delineating a plurality of break-away glue tabs 17. The front panel 12, top panel 18 and the bottom panel 20 each have side flaps 30, 32, 26, 26, 34, 36. There are no side flaps on the rear panel 16, or on the front hanger panel 22, or on the rear hanger panel 24.

The front panel 12 has a left side flap 30 and a right side flap 32. Each of these side flaps 30, 32 has an appended glue flap 31, 33. The left side glue flap 31 is appended to the left side flap 30 and the right side glue flap 33 is attached to the right side flap 32. There is a weakened area 15 between each of the glue flaps 31, 33 and the side flap 30, 32 to which it is appended. Each of the right side glue flap 32 and the left side glue flap 30 has a plurality of glue tabs 38, each glue tab 38 outlined with a weakened area 38(*a*). The glue tabs 38 are a part of the tamper evident structure of the carton. The glue tabs 38 will attach to the inner surface of the rear panel 16 when the carton blank 11 has been folded to construct the carton 10 (shown in FIG. 4). When the carton 10 is opened the glue tabs 38 will remain attached to the inner surface of the rear panel 16 because the weakened areas 38(*a*) will sever. When it is seen that the glue tabs 38 are attached to the inner surface of the rear panel 16 there is evidence that the carton 10 has been opened or tampered. Similarly, the weakened lines 13 of the back panel provide the second hanger panel 24 with break-away glue tabs 17. When the rear panel 16 is pulled outward, the break-away glue tabs 17 sever along weakened lines 13 and remain attached to the front hanger panel 22.

The top panel 18 has a right side top flap 28 with a right side top flap recess 27, and a left side top flap 26 with a left side top flap recess 25. The bottom panel 20 has a right side bottom flap 36 which has a right side bottom flap recess 37 and a left side bottom flap 34 with a left side bottom flap recess 35. When the bottom panel 20 and the top panel 18, with their attached side flaps 34, 36, are folded to form the carton 10, the left side top panel flap recess 25 and the left side bottom panel flap recess 35 will form a single combined recess 25/35 along the inner surface of left side flap 30. Likewise the right side top panel flap recess 27 and the right side bottom panel flap 37 will form a combined recess 27/37 along the inner surface of the right side flap 32. These combined recesses 25/35 and 27/37 serve to secure the product separator 40 in the carton 10.

Figure 2:
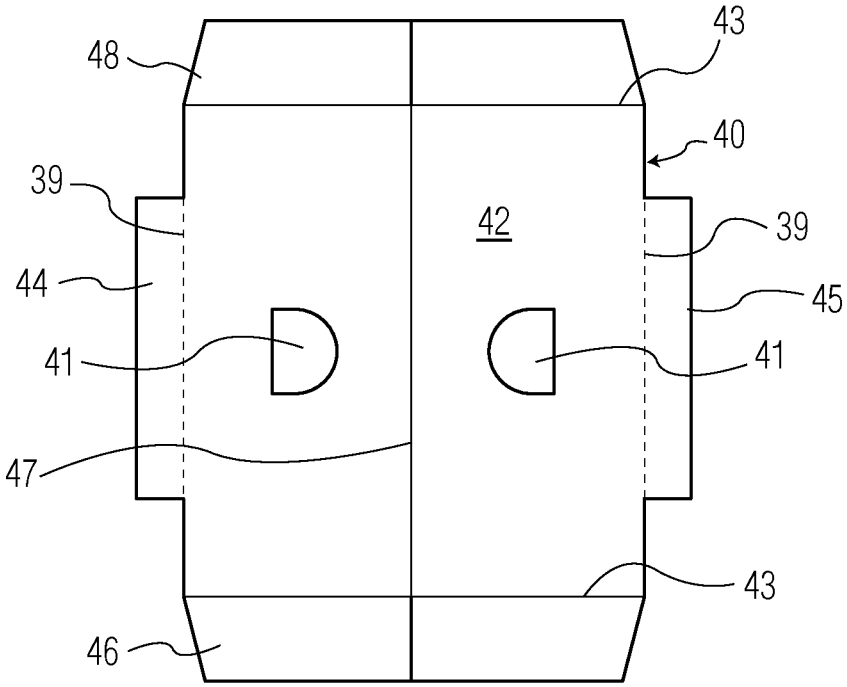
FIG. 2 is a plan view of the product separator for the carton.

The product separator 40 is shown in FIG. 2. This product separator 40 is comprised of a separator panel 42 with grip apertures 41. The separator panel 42 has a separator panel top flap 48 and a separator panel bottom flap 46. There can be a weakened area 47 to allow for a slight bending of the separator panel 42 when the grip apertures 41 are gripped and lightly pulled together. This facilitates the insertion and removal of the product separator 40 from the carton 10. The separator panel top flap 48 and a separator panel bottom flap 46 serve to align and support the product separator 40 in the carton 10. The separator panel 42 has a first panel 44 and a second panel 45. Between the separator panel 42 and the first panel 44 and a second panel 45 there is a weakened area 39 depicted as a scored line. There will be a bend of about 75 to 105 degrees at this weakened line 39. Usually the bend will be about 90 degrees. The first panel 44 and a second panel 45 will fit into combined recesses 25/35 and 27/37. The exact combined recess into which first locking panel 44 and a second locking panel 45 will fit into will be determined by the orientation of the product separator 40 when it is inserted into the carton 10. The product separator 40 is secured in the carton 10. Secured means that the product separator 40 is supported in a stable position when it is inserted into combined recessed 25/35 and 27/37. The product separator remains detachable and removable from the carton 10.

Figure 3:
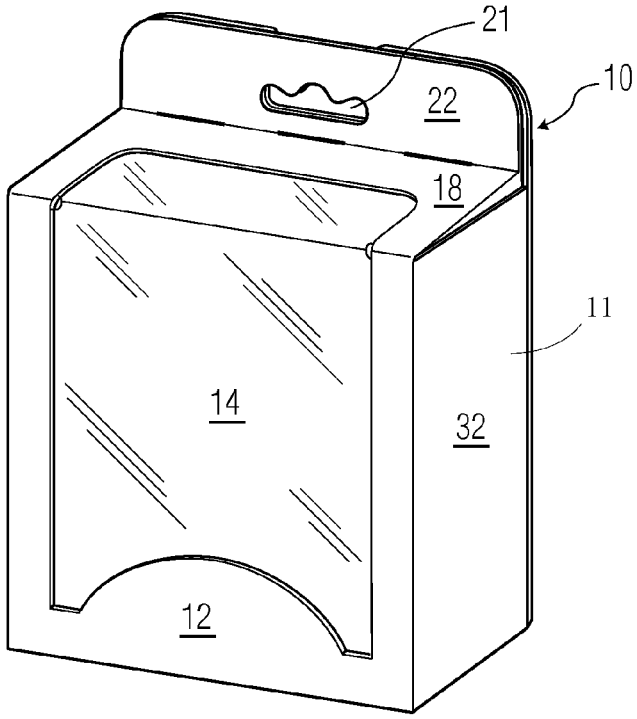
FIG. 3 is a perspective view of the carton.
Figure 4:
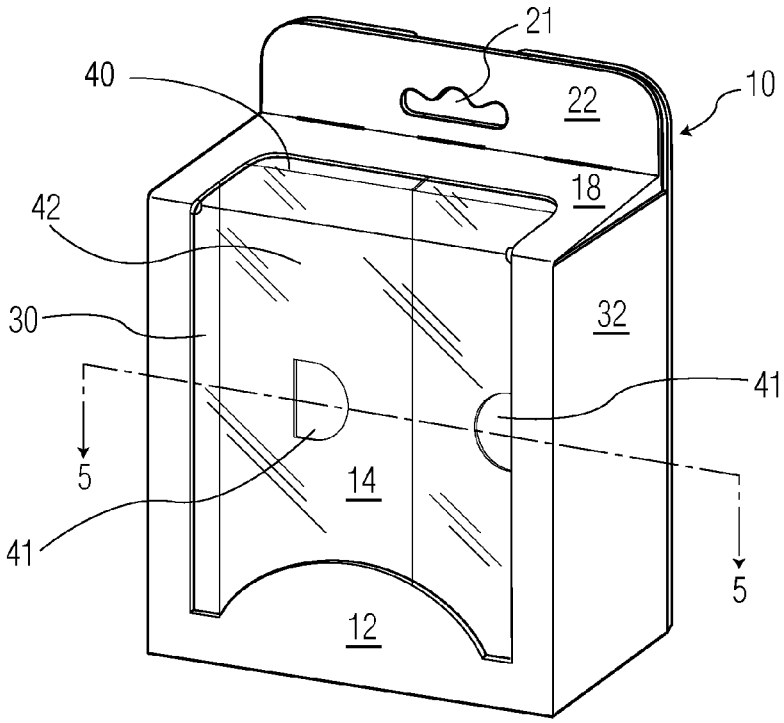
FIG. 4 is a perspective view of the carton of FIG. 3 with the product separator seen through a transparent front surface.

FIGS. 3 and 4 show carton 10 formed from the carton blank 11 of FIG. 1. FIG. 3 shows the carton 10 without the product separator 40 while FIG. 4 shows the carton 10 with the product separator 40. The carton 10 is comprised of front panel 12 with transparent front panel window 14. There is seen right side flap 32, top panel 18, and combined apertures of first hanger panel 22 with first hanger panel 22 and second hanger panel 24. In FIG. 4 there is additionally seen the inner surface of left side flap 30, the separator panel 42, and the separator panel grip apertures 41. All of the other parts of the carton 10 of FIG. 4 are the same as that shown in FIG. 3. All of the parts of the carton 10 of FIGS. 3 and 4 can be seen in the carton blank 11 of FIG. 1 and the product separator 40 of FIG. 2.

Figure 5:
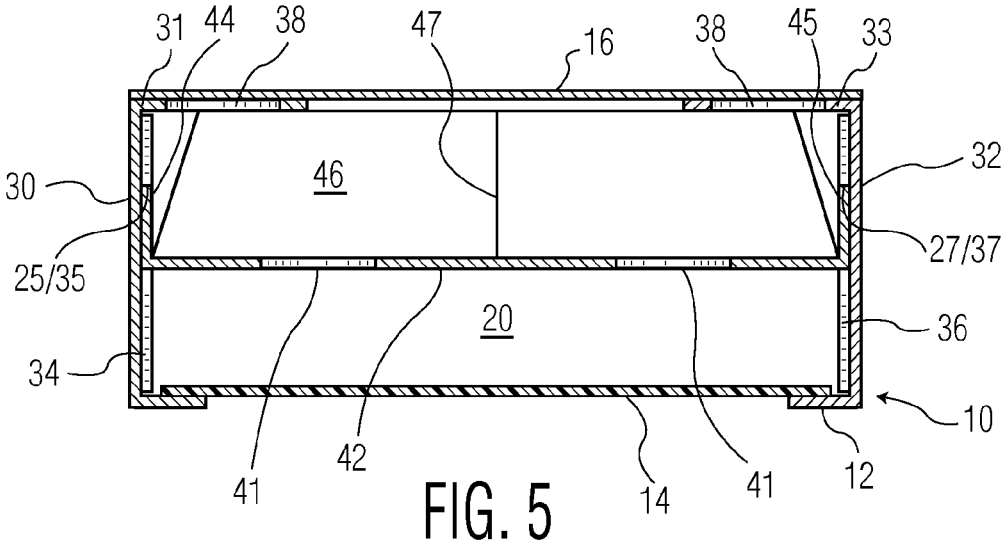
FIG. 5 is a cross-sectional view of the carton along line 5-5 of FIG. 4.

FIG. 5 is a cross-section of the carton 10 of FIG. 4 along line 5-5. There is shown in this view the carton 10 with front panel 12 and front panel window 14, rear panel 16 and bottom panel 20. The front panel 12 has left side flap 30 with attached left side glue flap 31 and right side flap 32 with attached right side glue flap 33. Each glue flap has glue tabs 38. These are attached to the inner surface of rear panel 16. Left side bottom flap 34 forms part of combined recess 25/35 and right side bottom flap 36 forms part of combined recess 35/37. The product separator 40 has grip apertures 41 with first panel 44 and second panel 45 of the separator panel 42. The first panel fits into combined recess 25/35 and second panel 45 fits into combined recess 27/37. The separator bottom panel 46 comprises the weakened bend area 47.

Figure 6:
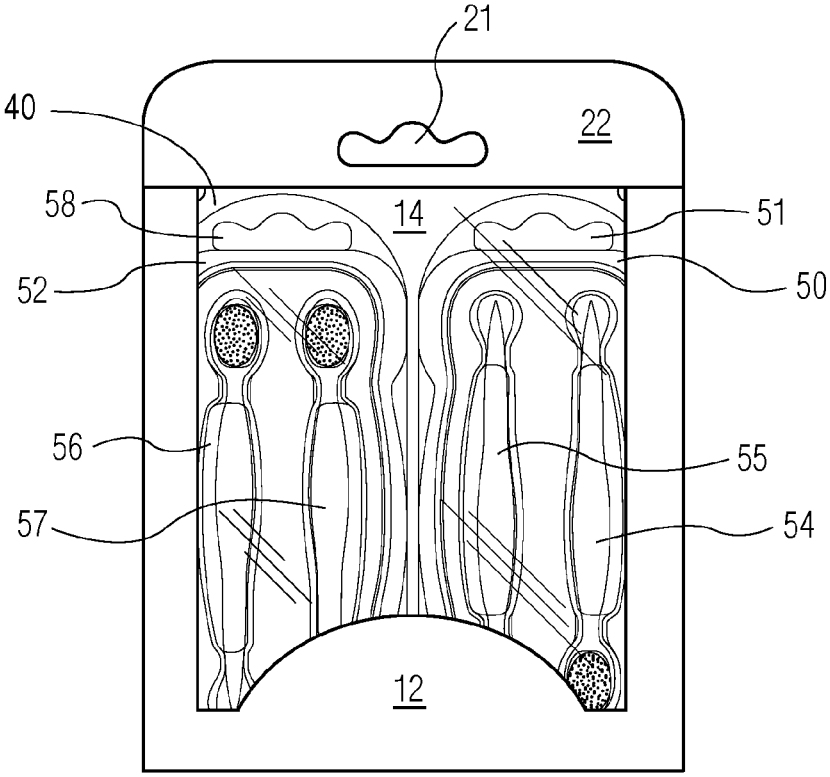
FIG. 6 is a front elevation view of the carton of FIG. 4 with two units of product displayed through the front surface.
Figure 7:
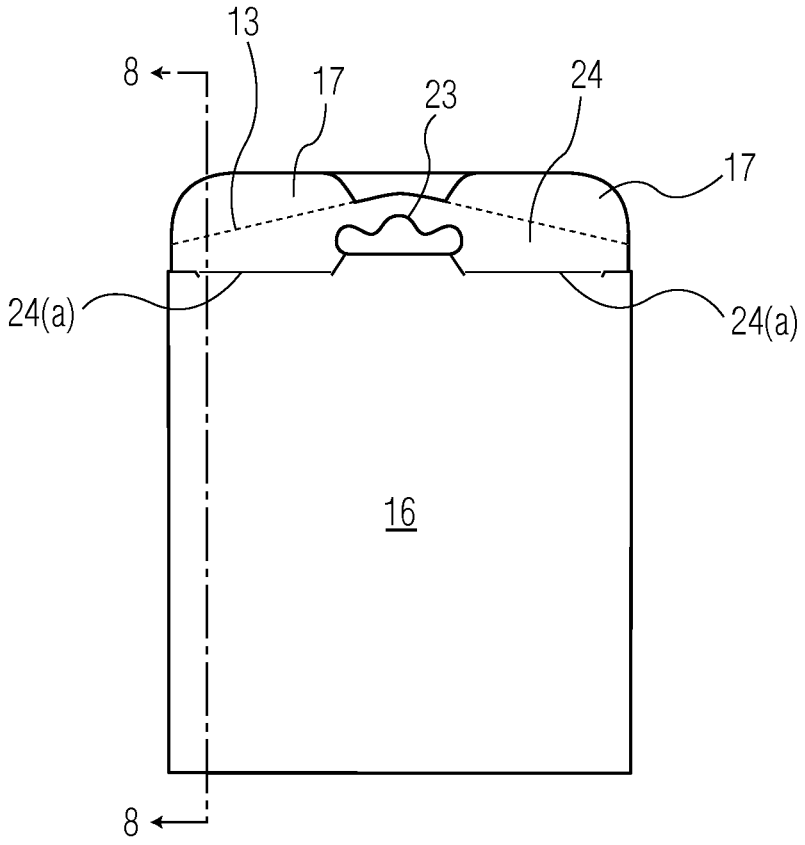
FIG. 7 is a rear elevation view of the carton of FIG. 4.

FIG. 6 is a front elevation view of the carton 10 filled with product packages 50 and 52. These product packages 50/52 are between the front panel 12 and the product separator 40. The product packages 50/52 are shown as thermoformed packs, each containing two portable toothbrushes. The thermoformed pack 50 contains toothbrushes 54 and 55 and has a product package aperture 51 for the option of hanging the product. The thermoformed pack 52 contains toothbrushes 56 and 57 and has a product package aperture 58. FIG. 7 is a rear elevation view of the carton 10. There is shown rear panel 16, second hanger panel 24 and second hanger panel aperture 23. The second hanger panel 24 reinforces the first hanger panel 22. The second hanger panel has weakened line 13 that delineates break-away glue tabs 17. There also is a fold line 24(*a*) where the remaining part of second hanger 24 can bend and aid in re-closing the carton after an initial opening. This is shown in more detail in FIG. 11.

Figure 8:
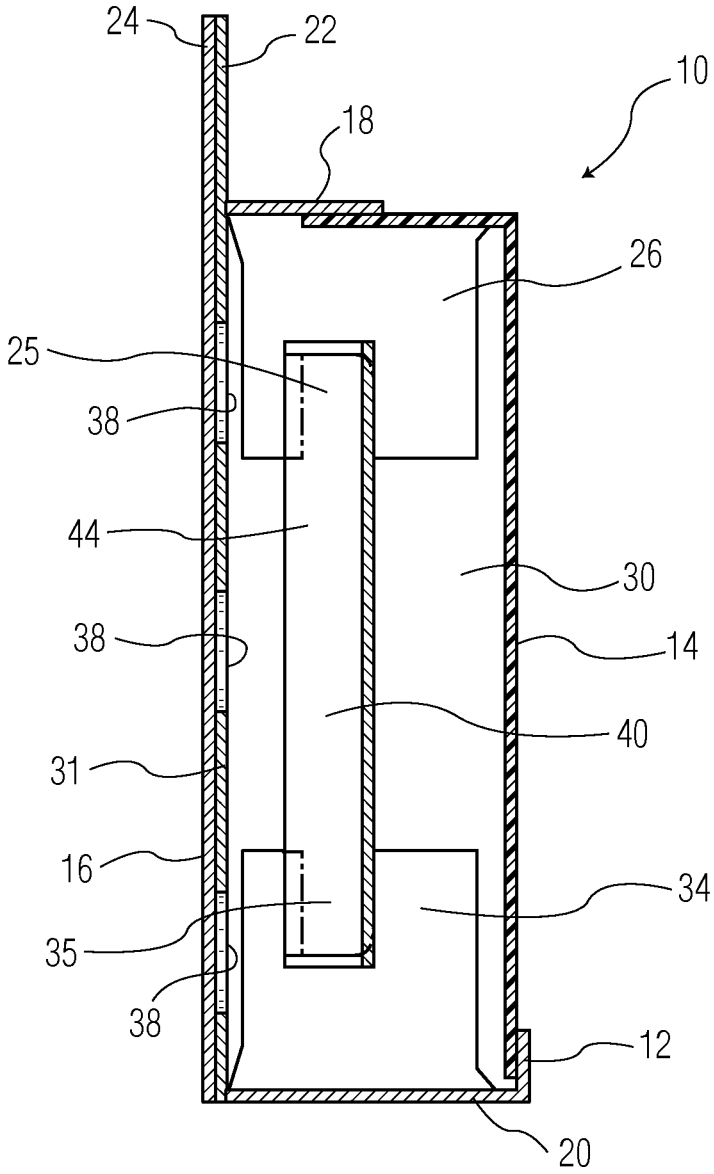
FIG. 8 is a cross-sectional view of the carton along line 8-8 of FIG. 7.

FIG. 8 is a cross-section view of a side of the carton 10 along line 8-8 of FIG. 7. This view shows the left side of the carton 10 with the product separator 40 in place. There is shown front panel 12 with front window panel 14. The top panel 18 and bottom panel 20 along with rear panel 16 complete the basic structure of the carton 10. The left side flap 30 has appended left side glue flap 31 with glue tabs 38. Glue tabs 38 attach the left side glue flap 31 to the rear panel 16. The top panel flap 26 and the bottom panel flap 34 form the combined recess 25/35 into which the first locking panel 44 of the separator 40 fits. This secures the separator 40 in place in the carton 10. The first hanger panel 22 and the second hanger panel 24 also are shown in this view.

Figure 9:
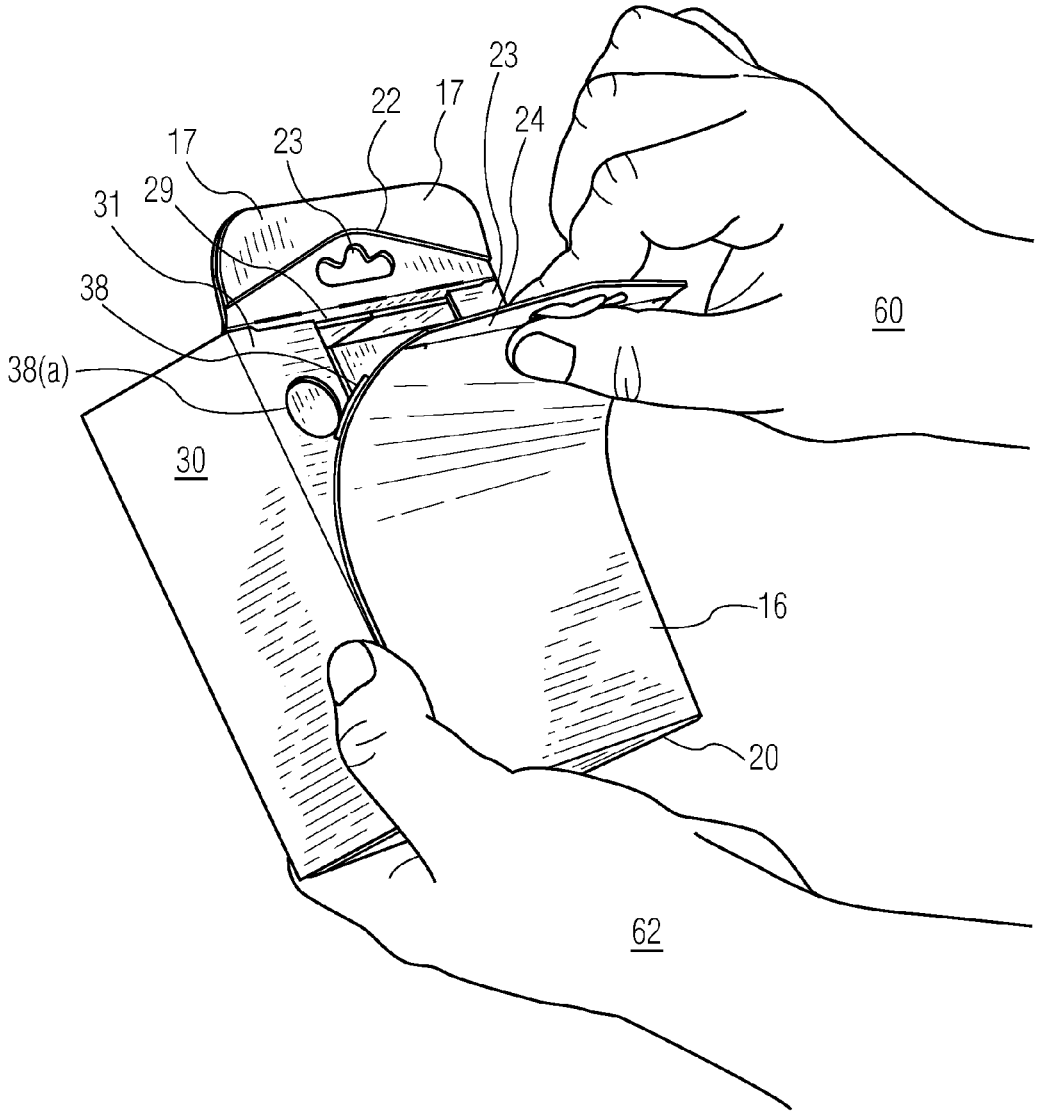
FIG. 9 is a view of the carton of FIG. 4 being opened.
Figure 10:
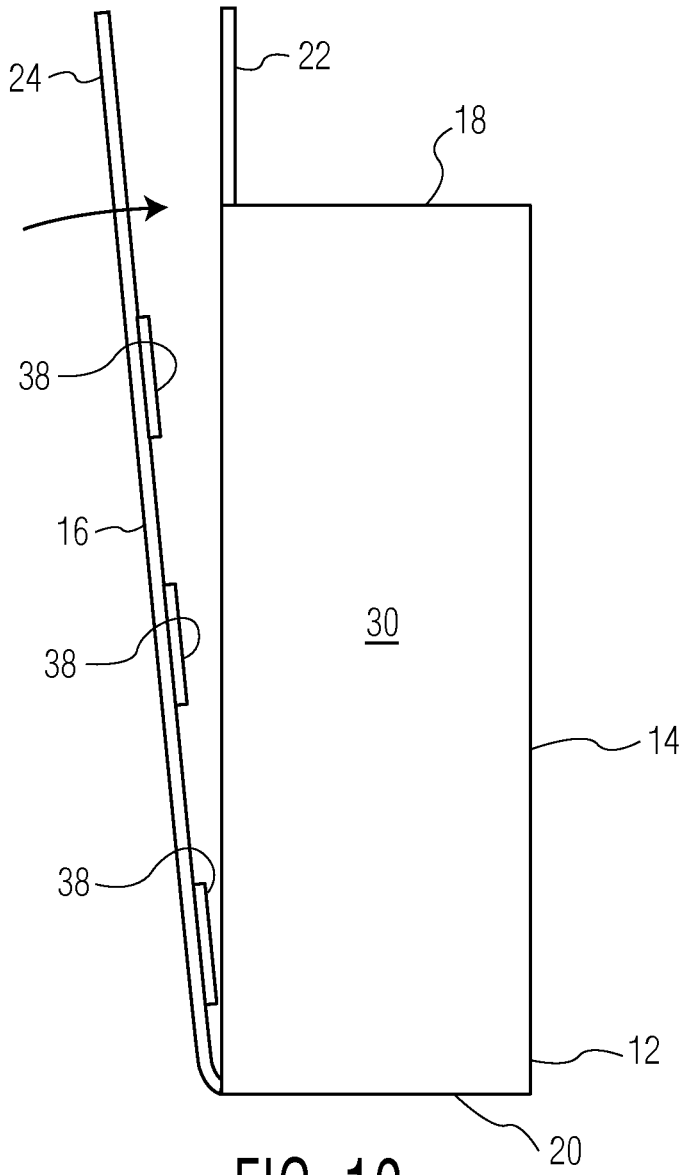
FIG. 10 is a view of the carton of FIG. 10 partially opened.
Figure 11:
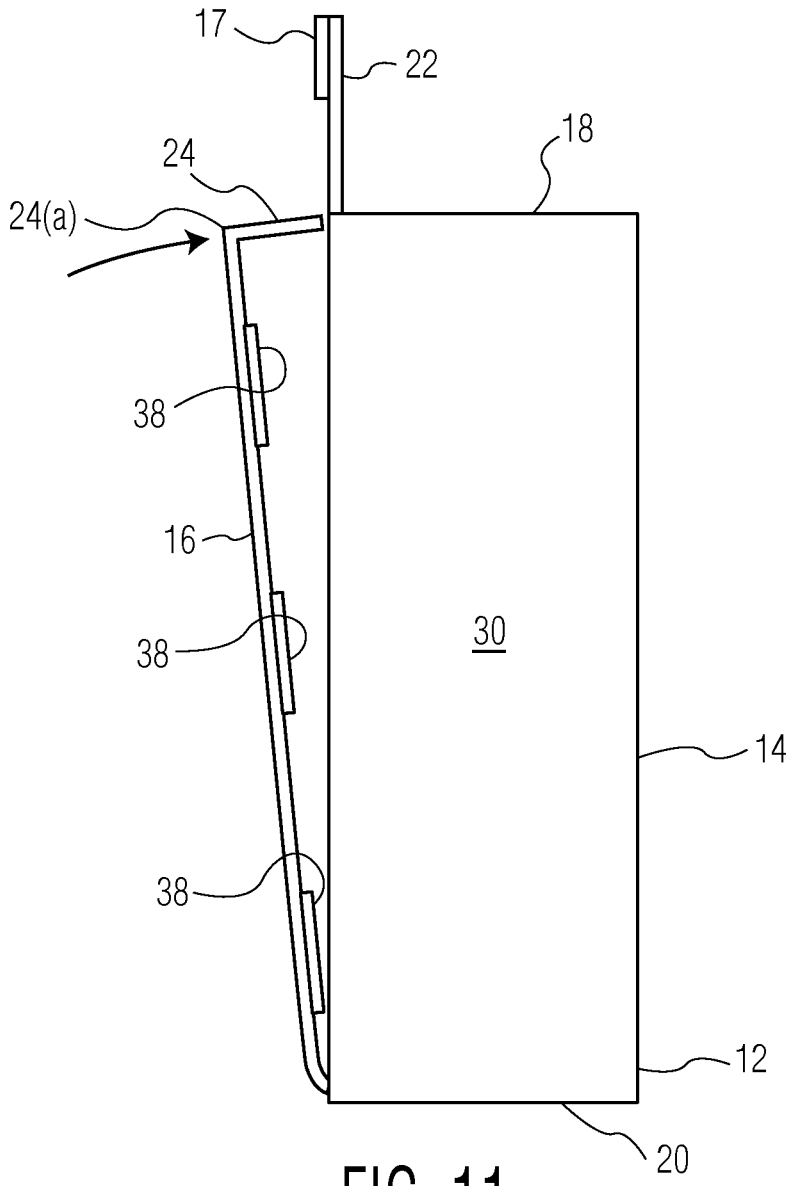
FIG. 11 is a view of the carton of FIG. 10 being reclosed.

FIG. 9 shows the carton 10 being opened. FIG. 10 shows the carton 10 partially opened. FIG. 11 shows the carton 10 being reclosed. In FIG. 9, hands 60 and 62 remove the rear panel 16 by pulling the rear panel 16 away from the remainder of the carton 10, thereby breaking the glue tabs 38. The glue tabs 38 are attached to the left side glue flap 31 prior to opening and to rear panel 16 after opening. When the rear panel 16 is fully removed the product units can be removed from the carton 10. Also shown in this view, are the second hanger panel 24 and the second hanger panel aperture 23. With this second hanger panel aperture 23 in combination with the first hanger panel aperture 21, the carton 10 can be displayed on a peg at a store. There is shown front panel 12 with front panel window 14, rear panel 16 and bottom panel 20. The rear panel 16 has the glue tabs 38 attached, these having been severed from left side glue flap 31 via weakened lines 38(*a*) on left side glue flap 31. The second hanger panel 24 and the first hanger panel 22 are shown separated with the carton being opened. The break-away glue tabs 17 are shown having been severed from the second hanger panel 24 and attached to the first hanger panel 22. The remaining part of the second hanger panel 24 can be gripped to open the carton 10. After an initial opening of the carton 10, the carton 10 can be reclosed and the remaining part of second hanger panel 24 folded to about a right angle and inserted into space 29 under the top panel 18. This will keep the rear panel 16 in a closed position until there is to be another removal of a product from the carton 10. This is shown in more detail in FIG. 11. This view shows the remaining part of second hanger panel 24 (breakaway tabs 17 removed) folded along line 24(*a*) and inserted into space 29 below top panel 18.

This carton 10 is useful in the display and sale of a wide range of products. A row of the products can be displayed inside the front panel window 14, between the front panel window 14 and the product separator 40. The products between the front panel window 14 and the product separator 40 will be held in a neat array. The products between the product separator 40 and the rear panel 16 can be in any array. These products will not be seen at the time of purchase. In FIG. 6 the products were shown to be toothbrushes. The carton 10 has been found particularly useful for this type of a product. However, it can be used for a wide range of products.

The carton 10 can be made of a wide range of materials. These range from various paperboards to various plastics. The paperboards can be virgin folding box boards and bleached boards. Also various grades of recycled paperboards can be used. The useful paperboards include various Swiss-boards. The paperboards have a weight of about 250 to about 500 g/m2 and a thickness of about 0.25 millimeter to about 1.5 millimeters. The plastics that can be used in place of paperboards include polyethylenes, polypropylenes, ethylene copolymers, propylene copolymers, vinyl polymers and copolymers, acrylic polymers and copolymers and polyesters such as polyethylene terephthalate. The transparent front panel window can be a clarified polypropylene, polyvinyl chloride or polyethylene terephthalate. The plastics will have a thickness of about 0.015 millimeters to about 0.25 millimeters.

We claim:

1. A carton comprising:

a front panel and a rear panel, the front panel and the rear panel connected one to the other by a top panel and a bottom panel, each of the front panel, the top panel and the bottom panel having appended side flaps, wherein the side flaps of the front panel have appended glue flaps and wherein the appended glue flaps attach to an inner surface of the rear panel;

a product separator in the carton, the product separator secured in the carton by recesses on the appended side flaps, the product separator separates the carton into a first cavity and a second cavity; and at least one product being disposed within each of the first cavity and the second cavity.

2. A carton as in claim 1 further comprising a weakened line between each of the appended side flaps of the front panel and the appended glue flaps.

3. A carton as in claim 2 wherein the appended glue flaps are at an angle to the side flaps of the from panel.

4. A carton as in claim 1 wherein each appended glue flap has a plurality of glue tabs.

5. A carton as in claim 1 wherein at least a part of the front panel is transparent.

6. A carton as in claim 5 wherein at least a part of the top panel is transparent.

7. A carton as in claim 1 wherein the top panel has an attached first hanger panel and the rear panel has an attached second hanger panel, the first hanger panel and the second hanger panel each having an aperture that forms a common hanger aperture when the first hanger panel is attached to the second hanger panel, the second hanger panel having a break-away glue tab portion and a remaining portion, wherein when the carton is opened by separating the second hanger panel from the first hanger panel, the remaining portion of the second hanger panel is foldable to reclose the carton.

8. A carton as in claim 7 wherein the second hanger panel has glue tabs, the glue tabs attaching the second hanger panel to the first hanger panel.

9. A carton as in claim 1 wherein the product separator has apertures and a separator weakened area in the separator panel to promote a partial fold of the separator panel.

10. A carton as in claim 1 wherein there is a first product positioned between the front panel and the separator panel and a second product positioned between the rear panel and the separator panel.

11. A carton as in claim 1 wherein the recesses of the side flaps of the top panel flaps are in alignment with the recesses of the bottom panel flaps to form combined recesses, and the carton further comprising a separator panel with a first panel and a second panel, each of the first panel and the second panel being fitted into as combined recess to thereby secure the product separator in the carton.

12. A carton as in claim 11 wherein the first panel and the second panel have a shape which conforms to the shape of the combined recesses.

13. A carton comprising a front panel and a rear panel, the front panel and the rear panel connected one to the other by a top panel and a bottom panel, each of the front panel, the top panel and the bottom panel having, appended side flaps, each of said appended side flaps having a recess, the recesses of the top panel flaps being in alignment with the recesses of the bottom panel flaps to form combined recesses, and the recesses of the appended side flaps being located adjacent the appended side flaps of the front panel, wherein the side flaps of the front panel have appended glue flaps and wherein each glue flap has a plurality of glue tabs.

14. A carton as in claim 13 further comprising a product separator in the carton, the product separator having a separator panel with a first panel and a second panel, each of the first panel and the second panel being fitted into a combined recess to thereby secure the product separator in the carton.

15. A carton as in claim 14 wherein there is a first product positioned between the front panel and the separator panel and a second product positioned between the rear panel and the separator panel.

16. A carton as in claim 13 wherein the top panel has an attached first hanger panel and the rear panel has an attached second hanger panel, the first hanger panel and the second hanger panel each having an aperture that forms a common hanger aperture when the first hanger panel is attached to the second hanger panel, the second hanger panel having a breakaway glue tab portion and a remaining portion, wherein when the carton is opened by separating the second hanger panel from the first hanger panel, the remaining portion of the second hanger panel is foldable to reclose the carton.

* * * * *